US005113894A

United States Patent [19]

Yoshida

[11] Patent Number: 5,113,894

[45] Date of Patent: May 19, 1992

[54] COUNTERBALANCE VALVE

[75] Inventor: Toshiyuki Yoshida, Kasaki, Japan

[73] Assignee: Kabushiki Kaisha Komatsu Seisakusho, Tokyo, Japan

[21] Appl. No.: 635,618

[22] PCT Filed: Apr. 20, 1990

[86] PCT No.: PCT/JP90/00516

§ 371 Date: Dec. 20, 1990

§ 102(e) Date: Dec. 20, 1990

[87] PCT Pub. No.: WO90/12973

PCT Pub. Date: Nov. 1, 1990

[30] Foreign Application Priority Data

Apr. 24, 1989 [JP] Japan ..... 1-101708

[51] Int. Cl.[5] ..... F15B 13/02

[52] U.S. Cl. ..... 137/106; 91/420

[58] Field of Search ..... 91/420; 137/106

[56] References Cited

U.S. PATENT DOCUMENTS 2,837,106 6/1958 Bauer ..... 137/106

FOREIGN PATENT DOCUMENTS 57-132863 8/1982 Japan .

1-122502 8/1989 Japan .

*Primary Examiner*—Gerald A. Michalsky

*Attorney, Agent, or Firm*—Richards, Medlock & Andrews

[57] ABSTRACT

A counterbalance valve for use in drive oil hydraulic circuitry of an oil hydraulic motor is constructed so that an oil hydraulic motor can slow down without shock, while cavitation is prevented, thus coming to rest in a short period time. A spool (26) is retained by springs in a neutral position. Pressurized oil in a left pressure receiving chamber (28) moves the spool (26) to a first position in which the port (23) on the second pump side is connected to the port (25) on the second motor side, whereas pressurized oil in a right pressure receiving chamber (29) moves the spool (26) to a second position in which the port (22) on the first pump side is connected to the port (24) on the first motor pump side. Throttle apertures (37, 38, 39) are arranged between the left pressure receiving chamber (28) and the port (22) on the first pump side, and throttle apertures (37, 38, 39) are also arranged between the right pressure receiving chamber (29) and the port (23) on the second pump side. When said spool (26) is in the first and second positions, the connection areas of the throttle apertures are maximum areas; when said spool (26) moves a little toward a neutral position, the connection areas become minimum areas; and when said spool (26) further moved toward the neutral position, the connection areas become intermediate areas.

9 Claims, 6 Drawing Sheets

COUNTERBALANCE VALVE

FIELD OF THE INVENTION

The present invention relates to a counterbalance valve provided for drive oil hydraulic circuitry of an oil hydraulic motor used in travel equipment or the like for construction machinery.

BACKGROUND ART

Conventional drive oil hydraulic circuitry of an oil hydraulic motor, for example, as shown in FIG. 7, is known.

In other words, more specifically, an operation valve 2 connects a delivery path 1*a* of an oil hydraulic pump 1 to a first main circuit 3 and a second main circuit 4, or the operation valve 2 disconnects the delivery path 1*a* from the first and second main circuits 3, 4. The first and second main circuits 3, 4 are respectively connected to a first port $6_1$ and a second port $6_2$ of an oil hydraulic motor 5. A counterbalance valve 7 is arranged between the first and second main circuits 3, 4. When the operation valve 2 is moved to a neutral position "N", because of non-return valves 8 placed in the first and second main circuits 3, 4, the side of the oil hydraulic motor 5 is disconnected from the counterbalance valve 7. Thus, the oil hydraulic motor 5 is not caused to rotate by an external force. When the operation valve 2 is moved to either a first position "I" or a second position "II", the counterbalance valve 7 is switched over to either the first position "I" or the second position "II", this switching being caused by highly pressurized oil in either the first main circuit 3 or the second main circuit 4.

The counterbalance valve 7 for use in such oil hydraulic circuitry is switched over to the first and second positions by highly pressurized oil in the first and second main circuits 3, 4. The counterbalance valve 7 returns to the neutral position "N" when the highly pressurized oil runs out.

When the oil hydraulic motor 5 is not driven by the first main circuit 3 or the second main circuit 4, it can be caused to rotate by an external load, thereby acting as a pump.

For this reason, if the counterbalance valve 7 is in the neutral position "N" when the oil hydraulic motor 5 is first rotated by an external load while the operation valve 2 is in the neutral position, either the first main circuit 3 or the second main circuit 4 becomes a high pressure circuit, thereby causing a great shock.

To moderate such a shock during cessation, the speed for the counterbalance valve 7 to return to the neutral position "N" from the first position and the second position is rendered slow. The counterbalance valve 7 throttles the pressurized oil in the first and second positions, thus causing it to flow to the tank 9.

For example, throttles 11, 11 are arranged in circuits 10, 10 which connect the first and second main circuits 3, 4 to the counterbalance valve 7. The speed for the counterbalance valve 7 to return to the neutral position "N" from the first and second positions is made slow by increasing the throttle amounts of these throttles 11, 11. In such an arrangement, however, the time required for the counterbalance 7 to return to the neutral position "N" is delayed. This causes cavitation and the oil hydraulic motor to stop for long periods.

An object of the present invention is therefore to provide a counterbalance valve in which an oil hydraulic motor can slow down without shock, while cavitation is prevented, thus coming to rest in a short period time.

DISCLOSURE OF THE INVENTION

A counterbalance valve of the present invention is constructed in such a manner that a right pressure receiving chamber and a left pressure receiving chamber are connected, through throttle apertures, to ports on a first pump side and a second pump side. These pressure receiving chambers move rightward or leftward along a spool. The connection areas of the throttle apertures, through which the pressure receiving chambers and the ports are connected to each other, are increased or decreased by the movement of the spool. At the beginning of a spool stroke when the spool moves to a neutral position from a first position or a second position, the connection areas become large; in the middle of the stroke, the connection areas become small; and at the end of the stroke, the connection areas again become large. In other words, while the spool is moving to the neutral position from either the first position or the second position, at the beginning of the spool stroke, pressurized oil in either the right pressure receiving chamber or the left pressure receiving chamber flows to either the port on the first pump side or the port on the second pump side. After the spool has moved to some extent, the pressurized oil is caused not to flow smoothly. When the spool moves further, the pressurized oil again flows smoothly. Thus, the speed at which the spool moves is fast at the beginning of the spool stroke, slow in the middle of the stroke, and again fast at the end of the stroke. For the above reasons, the spool can be returned to the neutral position while cavitation is prevented. At the same time, the ports on the first and second motor sides can be gradually connected to the ports on the first and second pump sides.

It is therefore possible to slow down and stop, without a shock, an oil hydraulic motor in a short period of time while cavitation is prevented.

BRIEF DESCRIPTION OF THE DRAWINGS

FIG. 1 is a cross-sectional view of a counterbalance valve;

FIGS. 2 through 4 are views explaining the operations of the counterbalance valve;

FIG. 5 is a diagram of drive oil hydraulic circuitry of an oil hydraulic motor;

FIG. 6 is a view showing an opening area, a switching pressure, and a spool return speed of the counterbalance valve with respect to the stroke of the counterbalance valve.

BEST MODE FOR CARRYING OUT THE INVENTION

Figure 7:
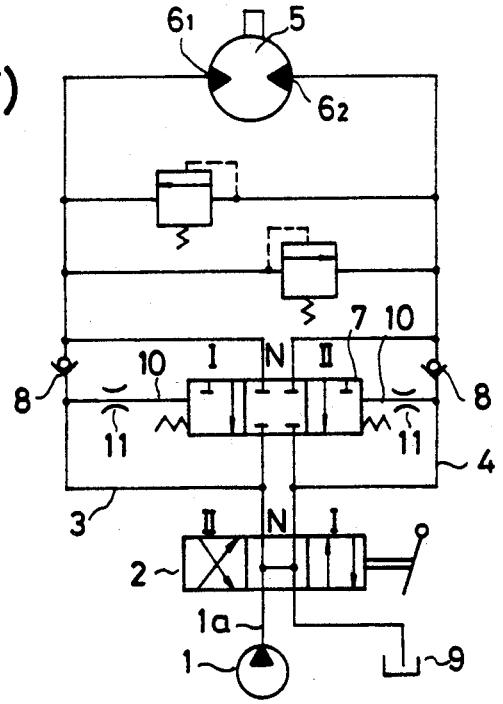
FIG.7 (PRIOR ART)
FIG. 7 is a diagram of the drive oil hydraulic circuitry of the conventional oil hydraulic motor.

An embodiment of the present invention will now be described in detail with reference to FIGS. 1 through 6. The drive oil hydraulic circuitry of an oil hydraulic motor shown in FIG. 5 is constructed in the same manner as is the conventional drive oil hydraulic circuitry shown in FIG. 7, except for the details of the counterbalance valve 7. The same components in FIG. 5 as those in FIG. 7 are designated by like reference characters.

Figure 1:
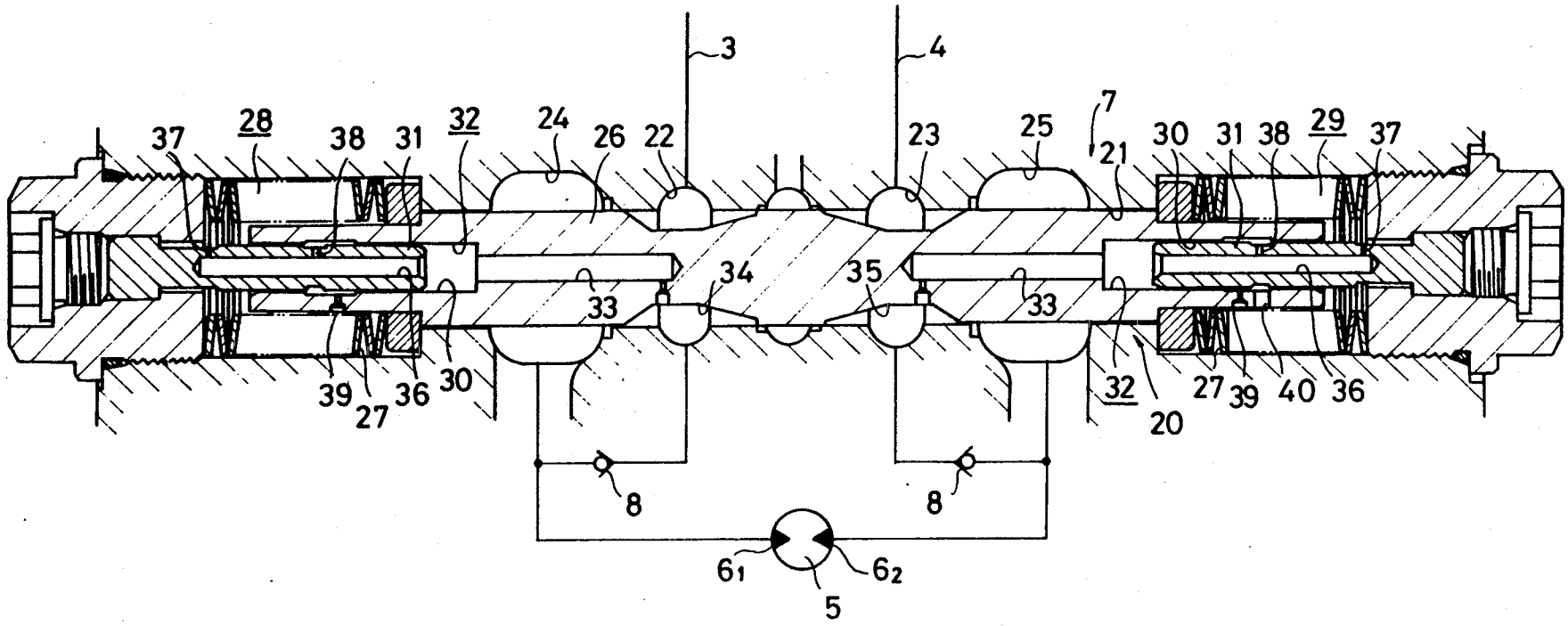
FIGS. 1 through 6 show an embodiment of the present invention.
Figure 2:
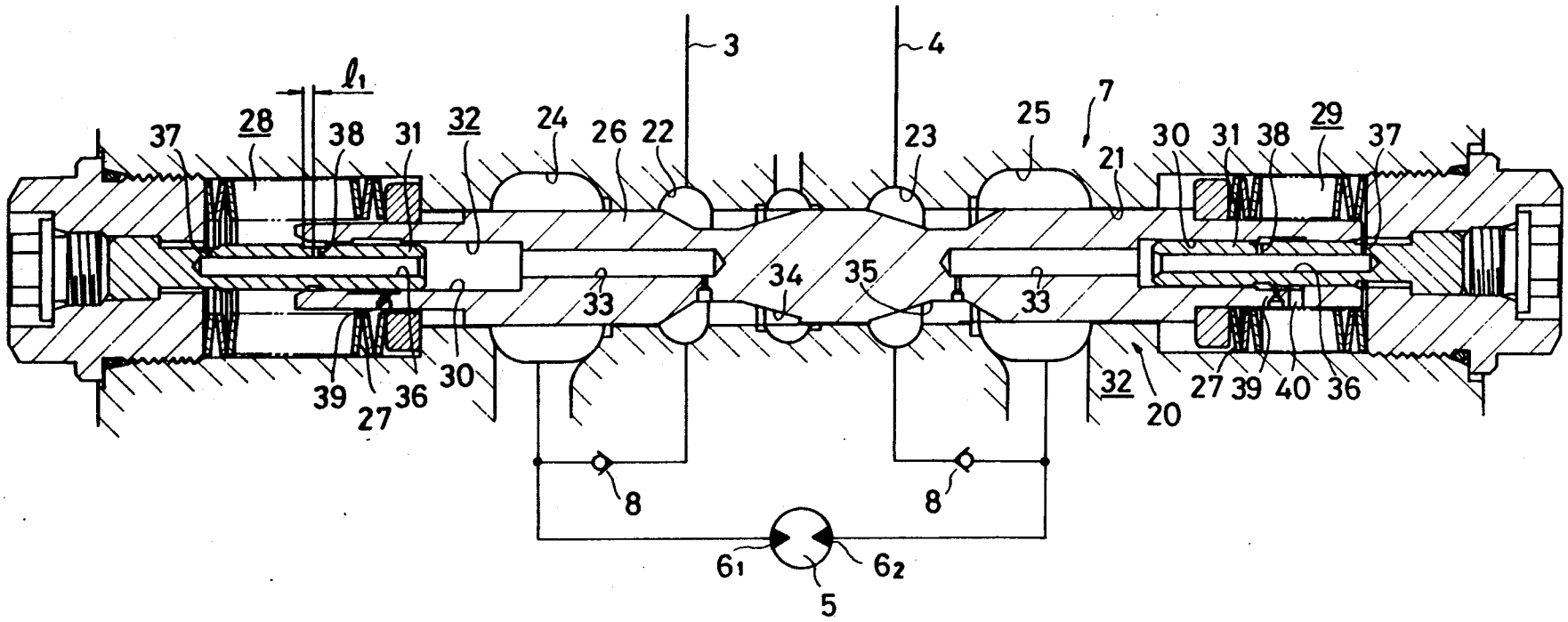

The counterbalance valve 7 of FIG. 5 has a valve body 20 as shown in detail in FIG. 1. The valve body 20 has a valve hole 21 formed therein. A port 22 on a first pump side, a port 23 on a second pump side, a port 24 on a first motor side, and a port 25 on a second motor side are formed around the valve hole 21. All of these ports are connected and disconnected by a spool 26 slidably fitted into the valve hole 21. The spool 26 is retained in a neutral position "N" by a pair of springs 27, 27, and slides toward a first position "I" and a second position "II" by the force of pressurized oil in a left pressure receiving chamber 28 and a right pressure receiving chamber 29.

Shaft holes 30 are formed on the right and left sides of the spool 26. Pistons 31 are fitted into the shaft holes 30, forming cylinder chambers 32. The cylinder chambers 32 are respectively open to a right small diameter portion 35 and a left small diameter portion 34 of the spool 26. The cylinder chambers 32 are open to these small diameter portions 34, 35 at oil holes 33 formed in the shaft center of the spool 26. Oil holes 36, formed in the shaft centers of the pistons 31, are connected to the cylinder chambers 32 through first throttle apertures 37 and second throttle apertures 38. The shaft holes 30 are open to the right pressure receiving chamber 29 and the left pressure receiving chamber 28 at third throttle apertures 39. The second throttle apertures 38 are connected to and disconnected from the right and left pressure receiving chambers 28, 29, and the third throttle apertures 39.

On the assumption that the diameter of the first throttle aperture 37 is represented by $d_1$; the diameter of the second throttle aperture 38 is represented by $d_2$; and the diameter of the third throttle aperture 39 is represented by $d_3$, then the relationship of these diameters is represented as follows:

$$d_1+d_2>d_1+d_3>d_1$$

The details and the operations of the components of the counterbalance valve 7 will now be explained. When an operation valve 2 is in a neutral position, the counterbalance valve 7 is also in the neutral position "N", and so is the spool 26 of the counterbalance valve 7 shown in FIG. 1.

Under the above conditions, when the operation valve 2 is moved to the first position "I", pressurized oil discharged from an oil hydraulic pump 1 is fed to a first main circuit 3. The pressurized oil in the first main circuit 3 then flows into the port 22 on the first pump side, the oil hole 33, and into the cylinder chamber 32. The pressurized oil further flows into the left pressure receiving chamber 28 through the first, second, and third throttle apertures 37, 38, 39. The spool 26 is thereby moved from the neutral position to the right, to the first position shown in FIG. 2, whereby the port 23 on the second pump side and the port 25 on the second motor side are connected to each other via the passage provided by the small diameter portion 35 of spool 26, while the port 22 on the first pump side and the port 24 on the first motor side remain unconnected via the counterbalance valve 7. The latter condition is the result of the passage provided by the small portion 34 of spool 26 being open to port 22 but disconnected from port 24 during the rightward motion from the neutral position. However, main circuit 3 is connected through port 22 and check valve 8 to port $6_1$. Thus, the pressurized oil is supplied from main circuit 3 through port 22 and check valve 8 to a first port $6_1$ of an oil hydraulic motor 5. It flows from a second port $6_2$ of the oil hydraulic motor 5 through the port 25 on the second motor side and the port 23 on the second pump side and then into a tank 9 (FIG. 5). Under the above conditions, the cylinder chamber 32 is opened and connected to the left pressure receiving chamber 28 through the first and second throttle apertures 37, 38.

When the operation valve 2 is returned to the neutral position "N" under the above conditions, the pressurized oil in the first main circuit 3 flows into the tank 9. The pressure falls, so that the spool 26 slides to the left by means of the spring 27. At this time, the pressurized oil in the left pressure receiving chamber 28 flows into the oil hole 36 through the first and second throttle apertures 37, 38. The pressurized oil then flows into the port 22 on the first pump side through the cylinder chamber 32 and the oil hole 33, further flowing into the tank 9 through the first main circuit 3. The area $d_1+d_2$ through which the left pressure receiving chamber 28 is connected to the oil hole 36 becomes maximum. The pressurized oil in the left pressure receiving chamber 28 smoothly flows into the tank 9. The spool 26 slides at a high speed.

Figure 3:
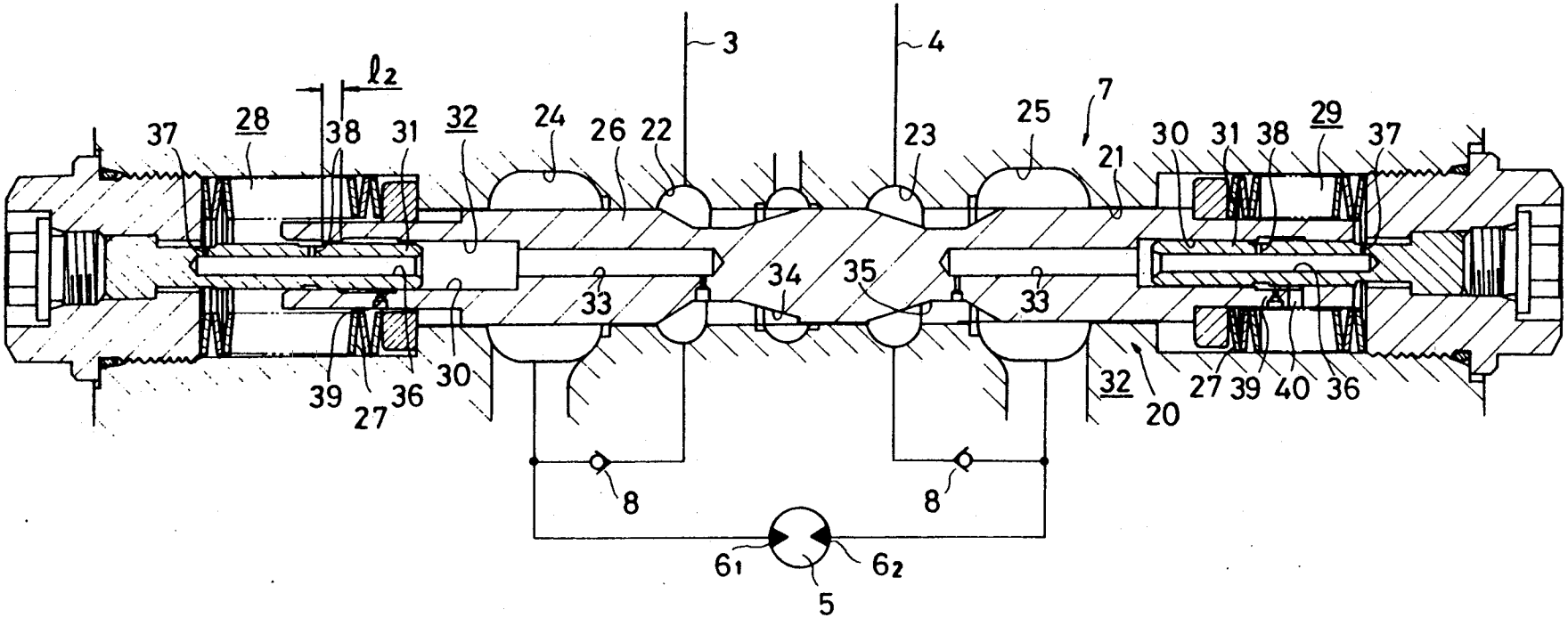

Now, when the spool 26 moves to the left a distance equal to only $l_1$, as illustrated in FIG. 3, the second throttle aperture 38 is disconnected from the shaft hole 30. The left pressure receiving chamber 28 is connected to the oil hole 33 only through the first throttle aperture 37. The area $d_1$ through which the left pressure receiving chamber 28 is connected to the oil hole 33 thus becomes minimum. The pressurized oil in the left pressure receiving chamber 28 gradually flows into the tank 9, whereby the spool 26 slides to the left at a low speed.

Figure 4:
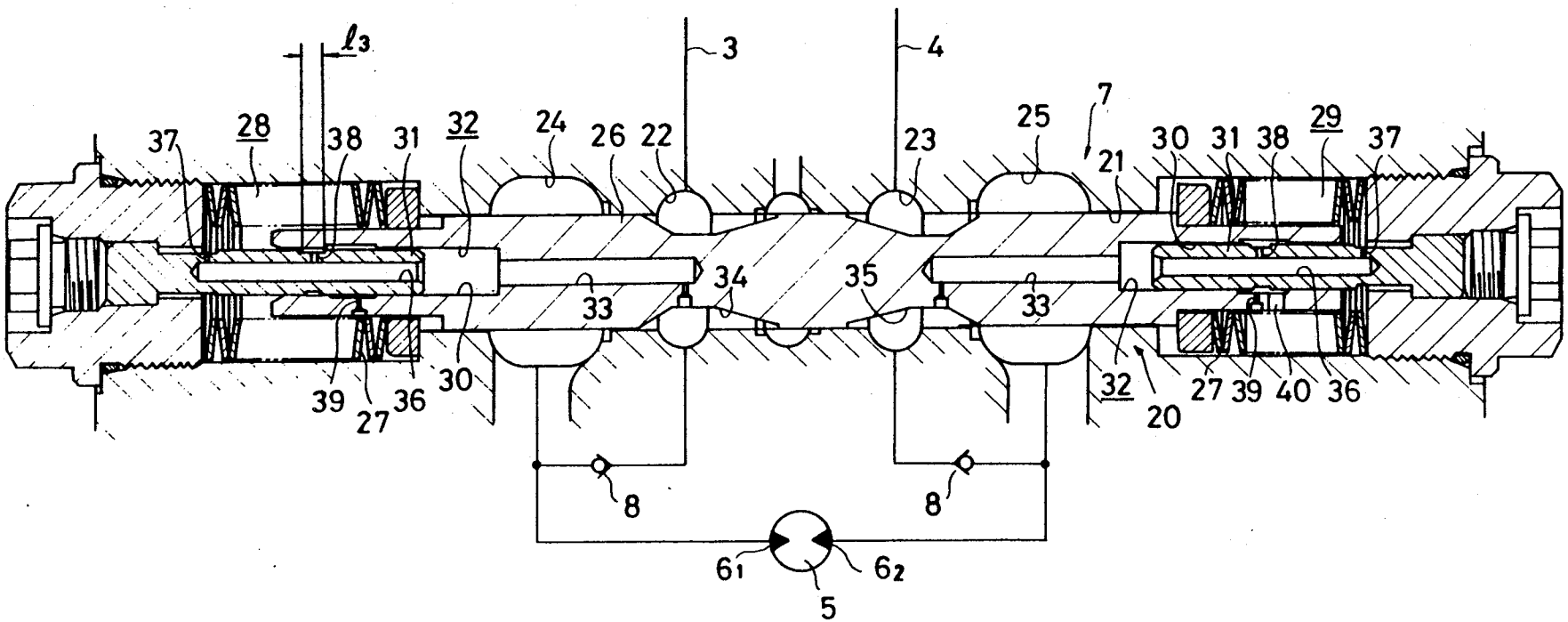
Figure 5:
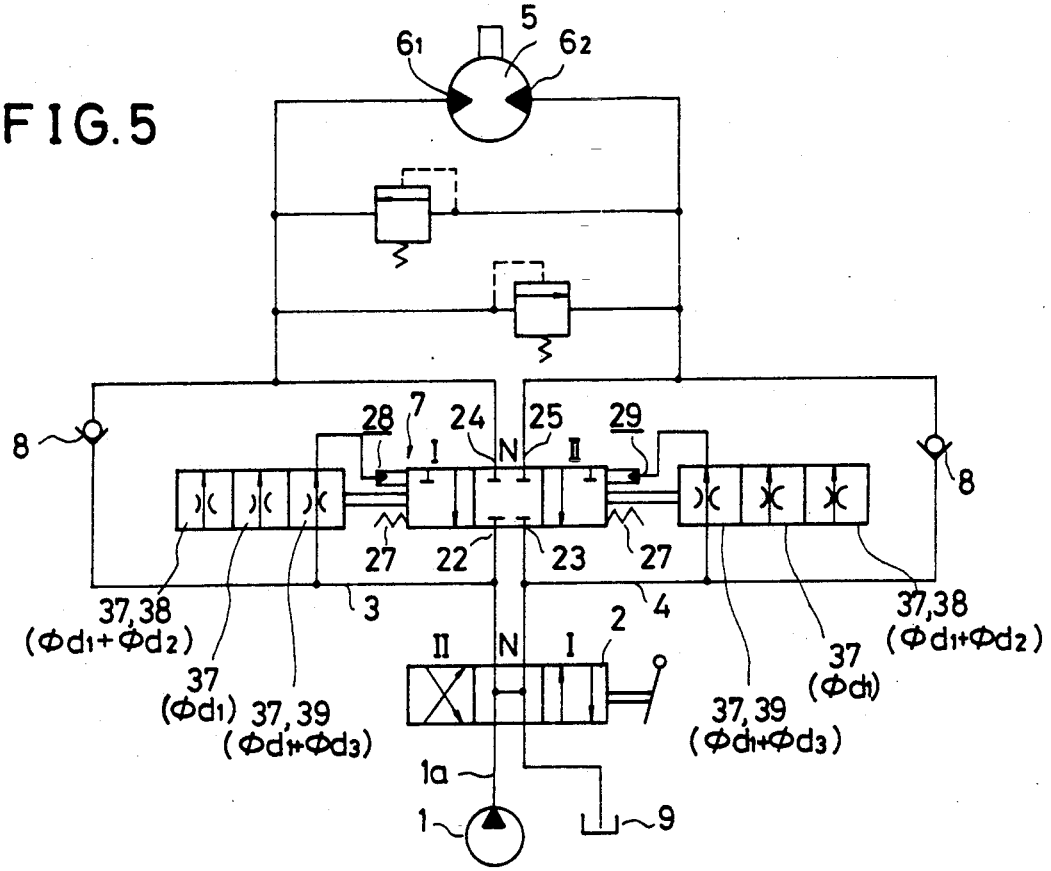

When the spool 26 further slides to the left a distance equal to only $l_2$, as shown in FIG. 4, the second throttle aperture 38 and the third throttle aperture 39 are connected to each other. The left pressure receiving chamber 28 is connected to the cylinder chamber 32 through the first throttle aperture 37 and the third throttle aperture 39. The area $d_1+d_3$ through which the left pressure receiving chamber 28 is connected to the cylinder chamber 32 becomes an intermediate area. The spool 26 thus slides at a speed which is intermediate between the high and low speeds. When the spool 26 moves a distance equal to only $l_3$, it returns to the neutral position shown FIG. 1.

Figure 6:
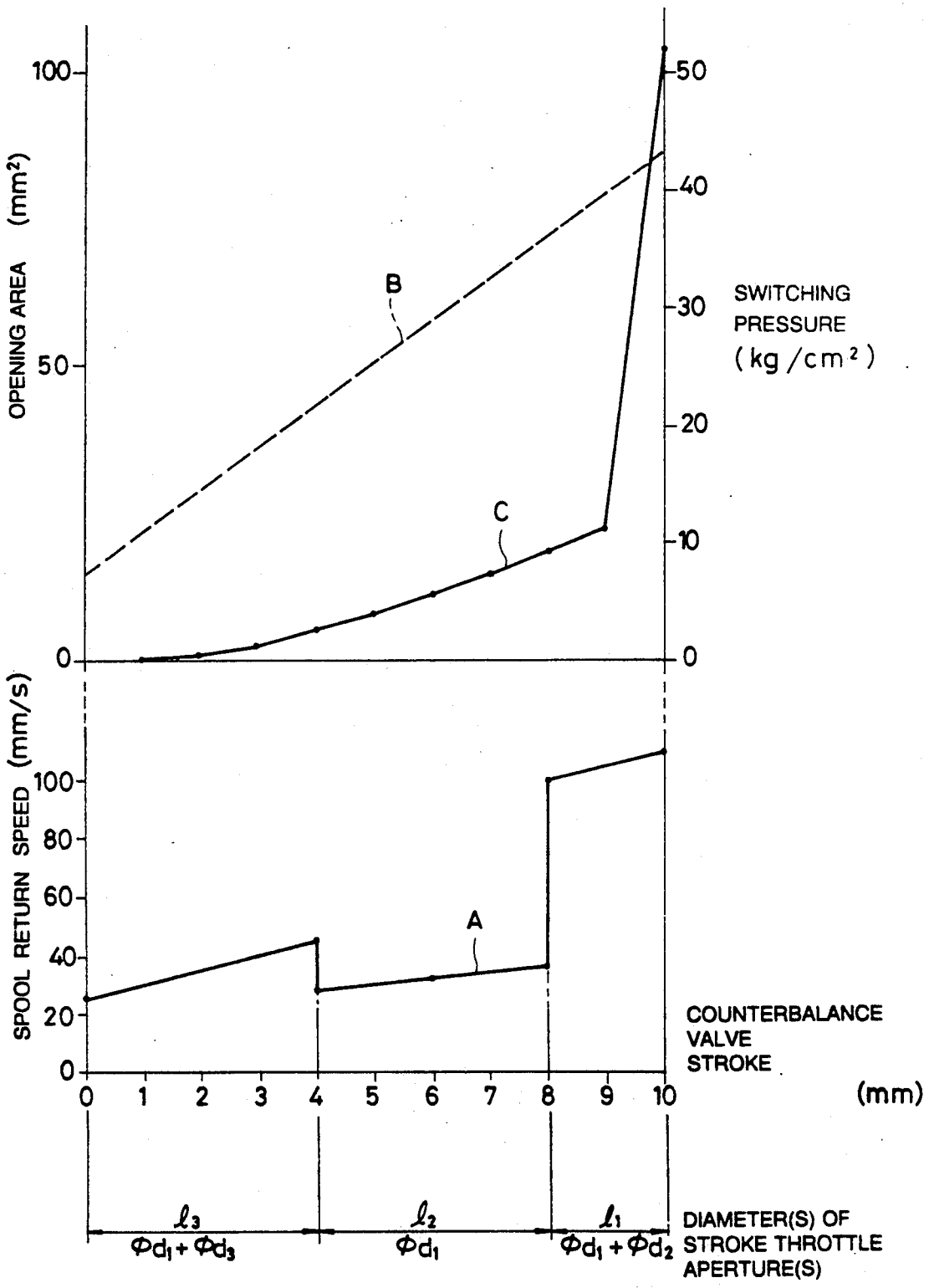

As has been described above, when the spool 26 of the counterbalance valve 7 slides to the neutral position from the first position, as indicated by the broken line "A" in FIG. 6, the spool 26 slides at a high speed at the beginning of the stroke, at a low speed at the intermediate period of the stroke, and at an intermediate speed at the end of the stroke. For the above reasons, the opening area of the counterbalance valve 7 and the switching pressure alter, as respectively indicated by the straight line "B" and the broken line "C" in FIG. 6. It is thus possible to prevent cavitation from occurring at the beginning of the stroke while the spool 26 is sliding at a high speed. The spool 26 can slow down, without a shock, during the intermediate period of the stroke while the spool 26 is sliding at a low speed. At the end of the stroke, the spool 26 can slide at an intermediate speed, returning to the neutral position. It is therefore possible to slow down and stop, without a shock, the oil hydraulic motor 5 in a short period of time while cavitation is prevented.

When the spool 26 slides to the neutral position from the second position (when the oil hydraulic motor 5 stops after it has rotated in the opposite direction), it is needless to say that the same operational effects can be attained as when the spool 26 slides to the neutral position from the first position as described above.

INDUSTRIAL APPLICABILITY

The counterbalance valve of the present invention is constructed in such a way that an oil hydraulic motor can slow down without shock, while cavitation is prevented, thus coming to rest in a short period time. The counterbalance valve is suitable for use in drive oil hydraulic circuitry of an oil hydraulic motor used in travel equipment or the like for construction machinery.

What is claimed is:

1. A counterbalance valve characterized in that a spool (26) is provided for a valve body (20) so that the spool (26) can slide rightward or leftward, the spool (26) being for connecting a port (22) on a first pump side and a port (23) on a second pump side to a port (24) on a first motor side and a port (25) on a second motor side and for disconnecting these ports (22, 23) on the first and second pump sides from the ports (24, 25) on the first and second motor sides, and characterized in that said spool (26) is constructed in such a way that said spool (26) is retained by springs in a neutral position in which the ports are disconnected from each other, and pressurized oil in a left pressure receiving chamber (28) moves said spool (26) from said neutral position to a first position in which the port (23) on the second pump side is connected to the port (25) on the second motor side while the port (22) on the first pump side is not connected via the spool (26) to the port (24) on the first motor side, whereas pressurized oil in a right pressure receiving chamber (29) moves the said spool (26) from said neutral position to a second position in which the port (22) on the first pump side is connected to the port (24) on the first motor side while the port (23) on the second pump side is not connected via the spool (26) to the port (25) on the second motor side, and characterized in that a first plurality of throttle apertures (37, 38, 39), connected to said left pressure receiving chamber (28) and said port (22) on the first pump side, are arranged between said left pressure receiving chamber (28) and said port (22) on the first pump side with the effective area of said first plurality of throttle apertures (37, 38, 39) varying with the position of said spool, and a second plurality of throttle apertures (37, 38, 39), connected to said right pressure receiving chamber (29) and said port (23) on the second pump side, are also arranged between said right pressure receiving chamber (29) and said port (23) on the second pump side with the effective area of said second plurality of throttle apertures (37, 38, 39) varying with the position of said spool.

2. A counterbalance valve according to claim 1 characterized in that connection areas of said first plurality of throttle apertures (37, 38, 39) and of said second plurality of throttle apertures (37, 38, 39) are constructed in such a manner that when said spool (26) is in either one of the first and second positions, the connection areas are maximum areas; when said spool (26) moves a little from said either one of the first and second positions toward the neutral position, the connection areas become minimum areas; and when said spool (26) moves further from said either one of the first and second positions toward the neutral position, the connection areas become intermediate areas which are intermediate between the maximum areas and the minimum areas.

3. A counterbalance valve comprising a valve body having a left fluid pressure receiving chamber, a right fluid pressure receiving chamber, and a spool passageway extending from said left pressure receiving chamber to said right pressure receiving chamber;

said valve body having a first pump side port, a second pump side port, a first motor side port, and a second motor side port, with each of said ports communicating with said spool passageway;

a spool positioned in said spool passageway for slidable movement therein between a first position, a second position, and a neutral position located between said first and second positions;

springs for biasing said spool to said neutral position, said ports beings disconnected from each other when said spool is in said neutral position;

a first variable throttle means associated with said spool and providing fluid communication between said left fluid pressure receiving chamber and said first pump side port, with the effective area of said first variable throttle means varying with the position of said spool in said spool passageway; and a second variable throttle means associated with said spool and providing fluid communication between said right fluid pressure receiving chamber and said second pump side port, with the effective area of said second variable throttle means varying with the position of said spool in said spool passageway;

wherein in said first position said spool provides a fluid connection between said second pump side port and said second motor side port, while the fluid connection in the counterbalance valve between said first pump side port and said first motor side port is blocked;

wherein said second position said spool provides a fluid connection between said first pump side port and said first motor side port, while the fluid connection in the counterbalance valve between said second pump side port and said second motor side port is blocked;

wherein the movement of the spool from said neutral position to either said first position or said second position is the result of the difference between the fluid pressure in said left fluid pressure receiving chamber and the fluid pressure in said right fluid pressure receiving chamber overcoming the biasing effect of said springs;

wherein the rate of movement of the spool from said first position toward said neutral position is responsive to the rate of flow of fluid from said left fluid pressure receiving chamber through said first variable throttle means; and wherein the rate of movement of the spool from said second position toward said neutral position is responsive to the rate of flow of fluid from said right fluid pressure receiving chamber through said second variable throttle means.

4. A counterbalance valve in accordance with claim 3 wherein said first variable throttle means comprises a first plurality of throttle apertures associated with said spool and providing fluid communication between said left fluid pressure receiving chamber and said first pump side port; and wherein said second variable throttle means comprises a second plurality of throttle apertures associated with said spool and providing fluid communication between said right fluid pressure receiving chamber and said second pump side port.

5. A counterbalance valve in accordance with claim 4 wherein the effective area of said first plurality of throttle apertures is a high value at the beginning of the movement of the spool from said first position toward said neutral position, then decreases to a low value and then increases to a value intermediate said high value and said low value prior to said spool reaching said neutral position.

6. A counterbalance valve in accordance with claim 5 wherein the effective area of said second plurality of throttle apertures is a second high value at the beginning of the movement of the spool from said second position toward said neutral position, then decreases to a second low value and then increases to a value intermediate said second high value and said second low value prior to said spool reaching said neutral position.

7. A counterbalance valve in accordance with claim 4 wherein said first plurality of throttle apertures comprises first, second and third throttle apertures in said spool, the sum of the areas of said first and second throttle apertures being greater than the sum of the areas of the first and third throttle apertures;

wherein the fluid communication from said left fluid pressure receiving chamber through said first throttle aperture to said first pump side port is always open;

wherein the fluid communication from said left fluid pressure receiving chamber through said third throttle aperture to said first pump side port is blocked and fluid communication from said left fluid pressure receiving chamber through said second throttle aperture to said first pump side port is open when said spool is in said first position;

wherein the fluid communication from said left fluid pressure receiving chamber through said second and third throttle apertures to said first pump side port is blocked when said spool is in a first intermediate position between said first position and said neutral position; and wherein the second and third throttle apertures are connected in series with fluid communication therethrough from said left fluid pressure receiving chamber to said first pump side port being open when said spool is in a second intermediate position between said first intermediate position and said neutral position.

8. A counterbalance valve in accordance with claim 7 wherein said second plurality of throttle apertures comprises fourth, fifth and sixth throttle apertures in said spool, the sum of the areas of said fourth and fifth throttle apertures being greater than the sum of the areas of the fourth and sixth throttle apertures;

wherein the fluid communication from said right fluid pressure receiving chamber through said fourth throttle aperture to said second pump side port is always open;

wherein the fluid communication from said right fluid pressure receiving chamber through said sixth throttle aperture to said second pump side port is blocked and fluid communication from said right fluid pressure receiving chamber through said fifth throttle aperture to said second pump side port is open when said spool is in said second position;

wherein the fluid communication from said right fluid pressure receiving chamber through said fifth and sixth throttle apertures to said second pump side port is blocked when said spool is in a third intermediate position between said second position and said neutral position; and wherein the fifth and sixth throttle apertures are connected in series with fluid communication therethrough from said right fluid pressure receiving chamber to said second pump side port being open when said spool is in a fourth intermediate position between said third intermediate position and said neutral position.

9. A counterbalance valve in accordance with claim 8 wherein said spool further comprises a first axial bore in the first end thereof and a second axial bore in the second end thereof, a passageway between an inner portion of said first bore and said first pump side port, and a passageway between an inner portion of said second bore and said second pump side port;

wherein a first piston is positioned in said first bore so as to permit relative movement between said first piston and said spool, said first piston having a first longitudinal passageway therein opening into said first bore;

wherein a second piston is positioned in said second bore so as to permit relative movement between said second piston and said spool, said second piston having a second longitudinal passageway therein opening into said second bore;

wherein said first throttle aperture is positioned in said first piston and extends between said left fluid pressure receiving chamber and said first longitudinal passageway;

wherein said second throttle aperture is positioned in said first piston and extends between the exterior of said first piston and said first longitudinal passageway;

wherein said third throttle aperture is positioned in said spool and extends between said left fluid pressure receiving chamber and said first bore;

wherein said fourth throttle aperture is positioned in said second piston and extends between said right fluid pressure receiving chamber and said second longitudinal passageway;

wherein said fifth throttle aperture is positioned in said second piston and extends between the exterior of said second piston and said second longitudinal passageway; and wherein said sixth throttle aperture is positioned in said spool and extends between said right fluid pressure receiving chamber and said second bore.

* * * * *